United States Patent [19]

Pfarrwaller

[11] 3,986,529

[45] Oct. 19, 1976

[54] ECCENTRIC DRIVE FOR DRIVING THE SHAFTS OF A WEAVING MACHINE

[75] Inventor: Erwin Pfarrwaller, Winterthur, Switzerland

[73] Assignee: Sulzer Brothers Limited, Winterthur, Switzerland

[22] Filed: July 7, 1975

[21] Appl. No.: 593,380

[30] Foreign Application Priority Data

July 30, 1974 Switzerland ..... 10457/74

[52] U.S. Cl. ..... 139/79; 74/569

[51] Int. Cl.[2] ..... D03C 5/00

[58] Field of Search ..... 139/79–81, 139/55–57, 66 R; 74/512, 569

[56] References Cited

UNITED STATES PATENTS

| | | | |
|---|---|---|---|
| 831,816 | 9/1906 | Wilson | 74/569 |
| 2,318,903 | 5/1943 | Thomas | 74/569 |
| 2,335,988 | 12/1943 | Anderson | 74/569 |
| 2,482,312 | 9/1949 | Bachle | 74/569 X |
| 2,592,820 | 4/1952 | Moessinger | 139/79 X |
| 3,418,869 | 12/1968 | Herpich | 74/569 |
| 3,866,634 | 2/1975 | Rutkevich et al. | 139/79 |

*Primary Examiner*—James Kee Chi

*Attorney, Agent, or Firm*—Kenyon & Kenyon Reilly Carr & Chapin

[57] ABSTRACT

The eccentric drive for lifting the heddle frame uses a mounting arrangement by which cam rollers can be detachably mounted on a cam-follower lever. The mounting arrangement uses a roller journal which is secured by bolts to the lever and which serves as a mount for a roller. The diameter of the journal surface on which the roller rotates is relatively large to provide a low surface pressure of the roller on the journal.

6 Claims, 5 Drawing Figures

ECCENTRIC DRIVE FOR DRIVING THE SHAFTS OF A WEAVING MACHINE

This invention relates to an eccentric drive for driving the shafts of a weaving machine.

Various eccentric drives have been known for driving the shafts of a weaving machine. In one such drive, use has been made of a number of eccentrics and cooperating cam followers to reciprocate a heddle frame such as a frame described in U.S. Pat. No. 3,696,842. The cam followers have been in the form of rollers mounted on a pivotal lever by means of a pin or journal or the like made as an integral part of the lever. These pins act as a bearing for the rollers and have the rollers secured in place for rotation by means of a rivet and a securing ring. However, should it become necessary to replace a worn roller, either the rivet must be destroyed or the unit made up of the cam-follower lever and rollers must be replaced. Further, in such eccentric drives, the pin or journal for mounting a roller cannot be made of a material different from the lever nor a material which is, for example hardened, to withstand heavier stressing than the material used for the lever. Still further, it is difficult to machine the lever together with the two roller journals which are formed thereon and which project therefrom.

Accordingly, it is an object of the invention to provide an eccentric drive for lifting a heddle frame in which cam rollers can be easily removed and replaced.

It is another object of the invention to mount a cam roller of an eccentric drive in a weaving machine on a journal of a cam-follower lever which is of higher stress-resistant material than the lever.

It is another object of the invention to simplify the manufacture of the component parts of an eccentric drive for a weaving machine.

Briefly, the invention provides an eccentric drive for a reciprocal drive lifter of a heddle frame which comprises a pivotally mounted lever, at least one journal removably mounted on the lever, a cam roller rotatably mounted on the journal and a rotatable eccentric bearing against the cam roller to pivot the lever. The journal is provided with an external collar to define a recess with the lever in order to hold the roller laterally on the journal.

In one embodiment, a journal is formed with a centering pin which projects into an aperture of the lever while a plurality of bolts or screws disposed about the centering pin are used to secure the journal to the lever.

By securing the journal to the cam follower lever by screwing, the manufacture of the cam-follower lever is simplified. That is, the lever does not have to have journals for the rollers formed thereon. In the embodiment in which the journals are secured to the levers by screws, it is a very simple matter to release the journals from the lever when the roller is worn so that the roller can be replaced. Further, the roller journal can be made of a hardened material whereas the lever can be a casting. It is simpler to machine a lever devoid of journals than one with integrally formed journals and the journals can be fitted to the lever after machining. Also, the shape of the journal, and particularly, the diameter and axial extent thereof, can be better adapted to physical conditions determined by the adjacent cam-follower levers and by the adjacent eccentrics.

These and other objects and advantages will become more apparent from the following description taken in association with the accompanying drawings wherein.

Figure 1:
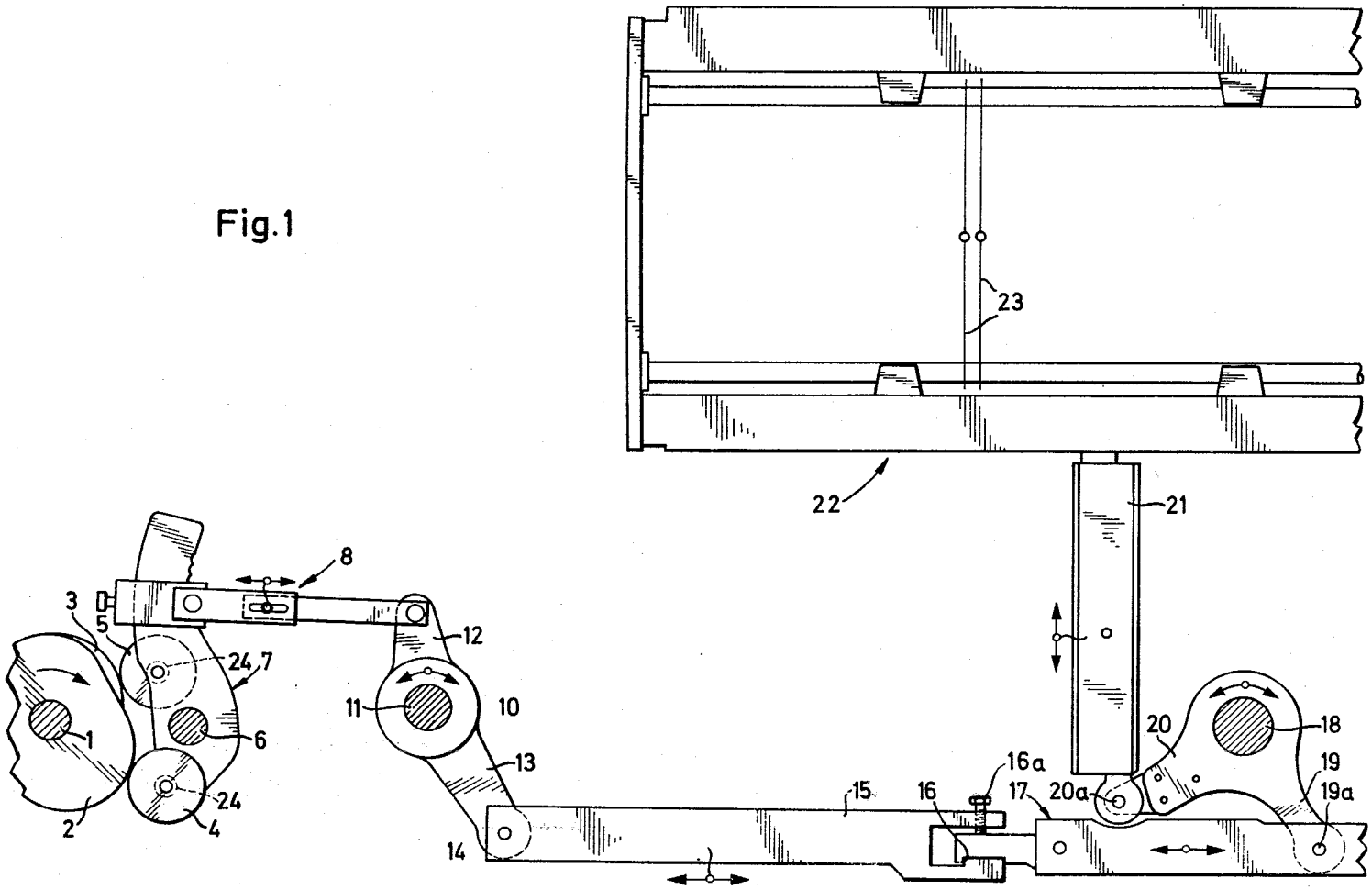
FIG. 1 illustrates a known drive for a heddle frame.

Referring to FIG. 1, an eccentric-machine shaft 1 which is driven off the main shaft of an associated weaving machine carries a number of eccentrics, only two, 2, 3, of which are indicated. The eccentrics 2, 3 together form an associated pair cooperating with rollers or cam-followers 4, 5 of a cam-follower lever 7 which is mounted for pivoting around a spindle 6. The lever 7 is pivotally connected by way of an adjustable link 8 to a double-armed reversing or deflecting lever 12, 13 pivoted to a spindle 11. One arm 13 of the lever is connected at a place 14 to a shaft (leaf) actuating linkage comprising a guide rod 15, a rod 17 connected to the guide rod 15 by a hook connection 16, a bell crank lever 19, 20 pivotable around a pivot 18, and a vertical bar 21. The bar 21 functions as a lifter and is connected to a heddle frame 22 and which carries warp heddles 23 for guiding warp yarns (now shown) for the shedding motions during weaving.

Figure 2:
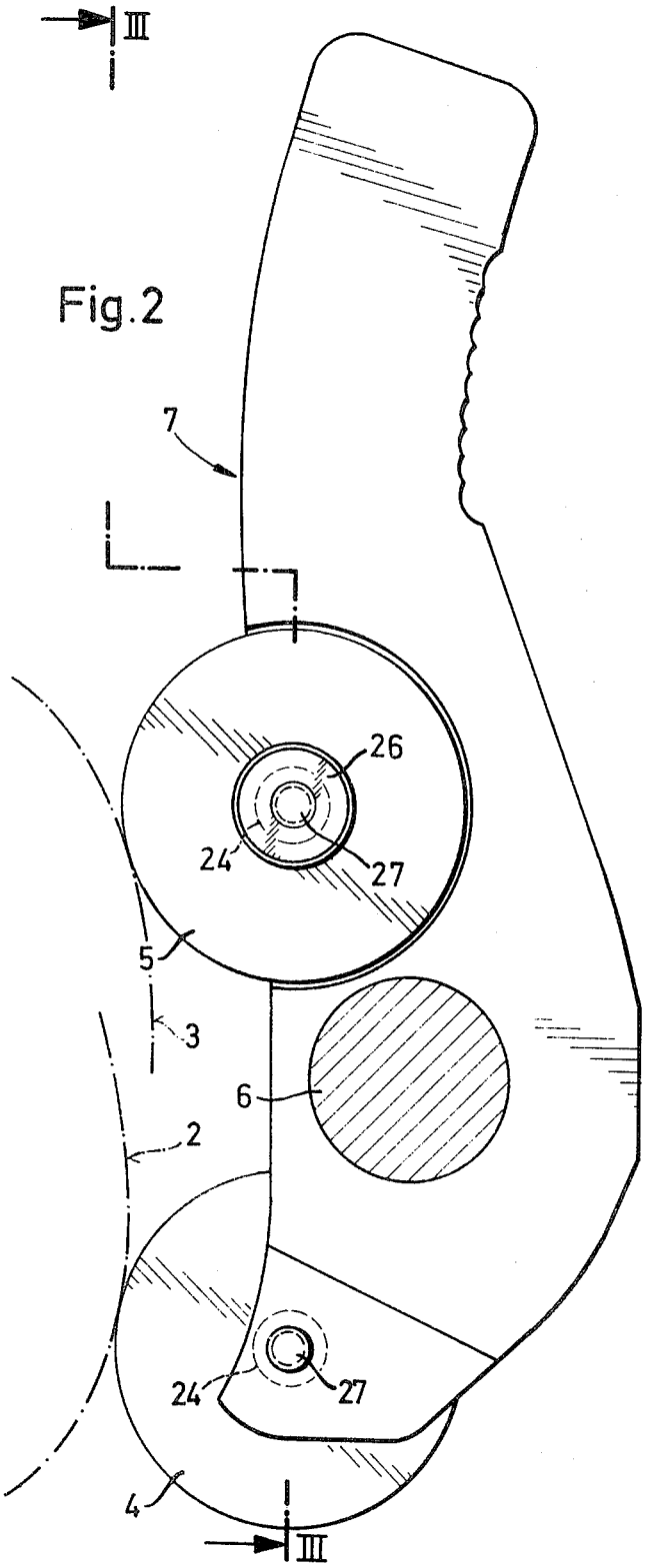
FIG. 2 illustrates an associated detail to an enlarged scale of a known construction of a cam-follower lever and cam follower.
Figure 3:
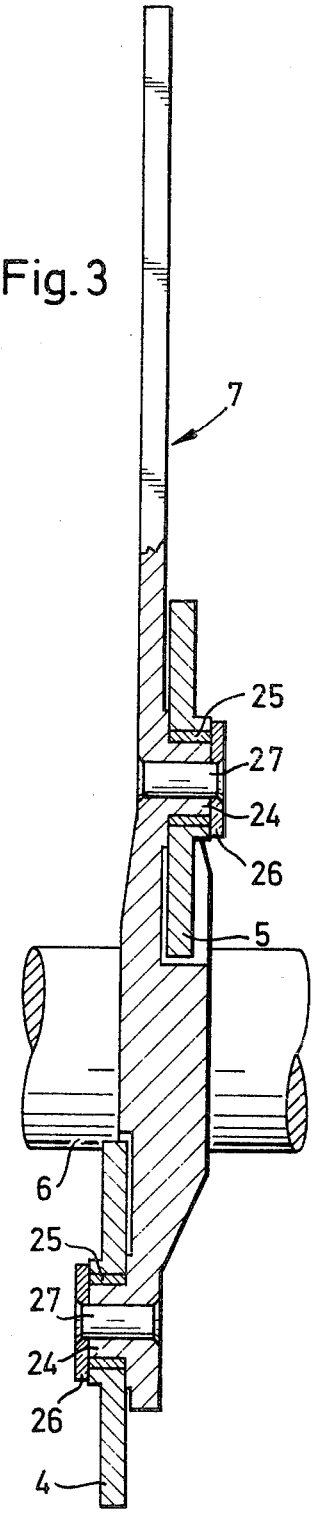
FIG. 3 illustrates a sectional view taken on line III—III of FIG. 2.

In the known construction shown in FIGS. 2 and 3, the lever 7 has journals 24 unitary therewith. The two rollers 4, 5 are mounted on the journals 24 with the interposition of bushings 25 and secured by means of securing rings 26 and rivets 27. The journal 14 has to receive all the forces transmitted by the eccentrics 1, 3 to the rollers 4, 5. In order to replace the rollers 4, 5, either rivet 27 must be knocked out or the complete lever 7 must be replaced. Further, as shown, the journals 24 are relatively narrow in diameter and have a relatively large axial extent.

Figure 4:
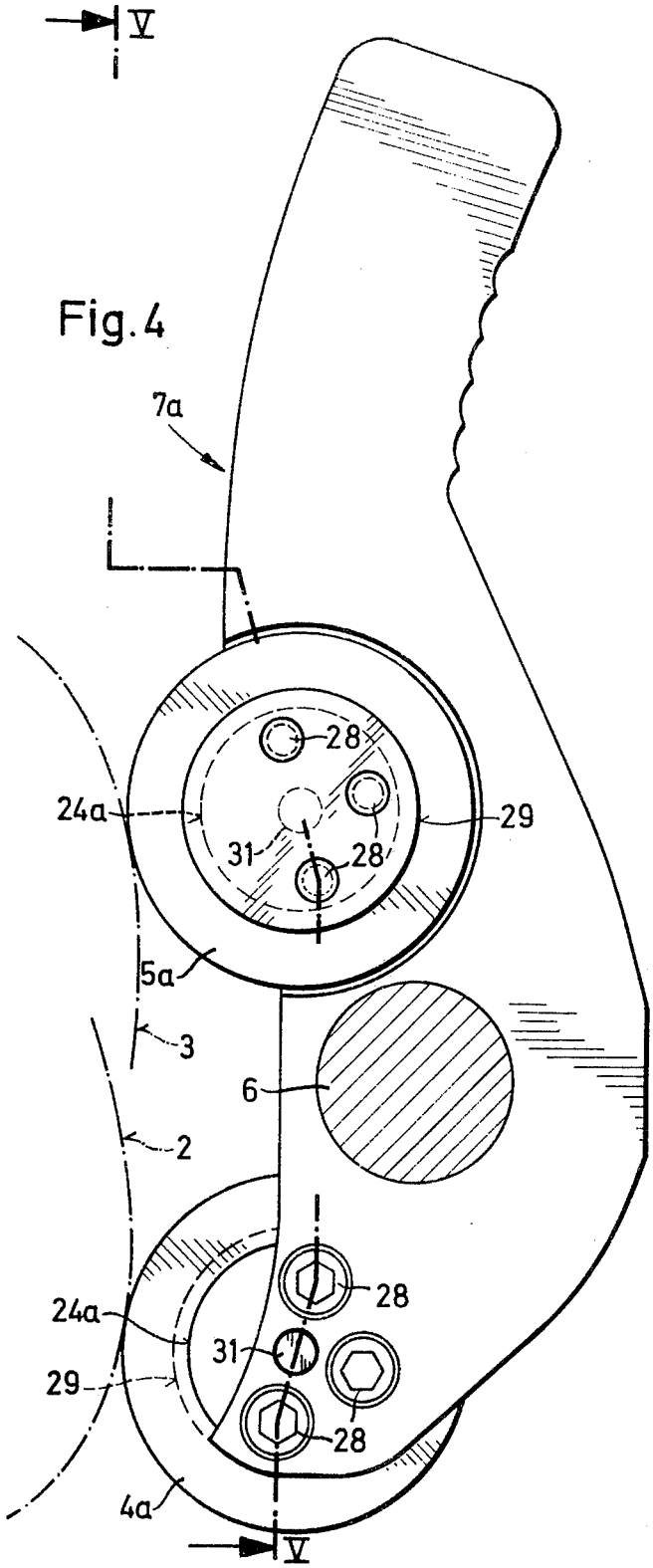
FIG. 4 illustrates a construction according to the invention.
Figure 5:
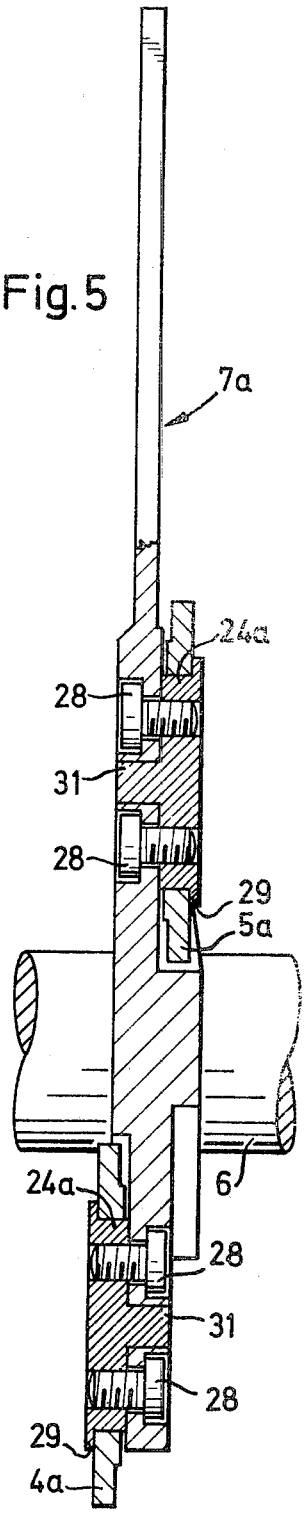
FIG. 5 illustrates a sectional view taken on line V—V of FIG. 4.

In the case of the cam follower lever **7*a* according to the invention and shown in FIGS. 4 and 5, however, two separate journals 24*a* are secured to the lever 7*a* by means of bolts or screws 28. Each journal 24*a* has an external collar 29 for securing the rollers 4*a*, 5*a* mounted on the journals 24*a* by defining a recess for the rollers 4*a*, 5*a* with the lever 7*a*. Each journal 24*a* also has a centering pin or projection 31 at the center which fits into an aperture or recess in the lever 7*a*. The screws 28 receive a considerable proportion of the forces applied by the eccentrics 1, 3 to the rollers 4*a*, 5*a*.**

As shown in FIG. 4, the bolts 28 number three for each roller **4*a*, 5*a* and are disposed circumferentially about the centering pin 31. Each bolt 28 passes through an opening in the lever 7*a* and is threaded into a threaded opening in the journal 24*a* (FIG. 5). Also, the head of each bolt 28 is countersunk in the lever 7*a*** to impart an overall flat profile.

The eccentric drive which incorporates the removably mounted journals **24*a* operates in the same way as the drive illustrated in FIG. 1 in order to reciprocate the guide rods 15, 17 and thus the heddle frame 22.**

In order to replace a roller **4*a*, 5*a*, the bolts 28 are unthreaded from a journal 24*a* and the journal 24*a* removed from the lever 7*a*. A new roller can then be placed on the journal 24***a*, and the journal 24*a* can then be fitted into place and secured by tightening of the bolts 28.

The journals 24*a* can, as shown, have a relatively large diameter, so that the running surface on which the rollers 4*a*, 5*a* rotate is increased and the surface pressure (bearing force per unit of surface area) of the rollers decreased correspondingly.

The shape, diameter and axial extent of the journals 24*a* can be adapted within relatively wide limits to the environment determined by the adjacent levers with their cam followers and by the associated adjacent eccentrics.

Alternatively, a centering projection corresponding to the pin 31 can be provided on the lever 7*a* to engage in a matching aperture in the journal 24*a*. Also, the screws 28 can be screwed into tapped bores of the lever and the screw heads countersunk in appropriate recesses in journal 24*a*.

What is claimed is:

1. An eccentric drive for a reciprocal drive lifter of a heddle frame comprising a pivotally mounted lever having at least one aperture therein, at least one journal removably mounted on said lever, said journal including a centering pin projecting into said aperture of said lever, a plurality of bolts removably securing said journal to said lever, said bolts being disposed about said centering pin, a cam roller rotatably mounted on said journal, and a rotatable eccentric bearing against said cam roller to pivot said lever.

2. An eccentric drive as set forth in claim 1 wherein said journal has an external collar defining a recess with said lever to hold said roller laterally on said journal.

3. An eccentric drive as set forth in claim 1 wherein said lever has a pair of apertures therein and which further comprises a pair of said journals, each said journal having a centering pin thereof received in a respective aperture of said lever, bolts removably securing each journal to said lever, a pair of said cam rollers, each said cam roller being mounted on a respective journal to bear against said eccentric.

4. In combination a heddle frame;

at least one lifter for lifting and lowering said frame;

means including a reciprocating guide rod for lifting and lowering said lifter; and an eccentric drive for reciprocating said guide rod, said drive including a pivotally mounted lever connected to said guide bar and having an aperture therein, at least one journal removably mounted on said lever and including a centering pin projecting into said aperture of said lever, bolts about said centering pin threadably securing said journal to said drive, a cam roller rotatably mounted on said journal and a rotatable eccentric bearing against said cam roller to pivot said lever.

5. The combination as set forth in claim 4 wherein said drive includes a pair of said journals on said lever and a pair of said rollers, each roller being mounted on a respective journal.

6. The combination as set forth in claim 5 wherein said drive further includes bolts threadably securing said journals to said lever.

* * * * *